US006213594B1

(12) United States Patent
Kitahara

(10) Patent No.: US 6,213,594 B1
(45) Date of Patent: Apr. 10, 2001

(54) INK-JET PRINTING HEAD FOR PREVENTING CROSSTALK

(75) Inventor: Tsuyoshi Kitahara, Nagano (JP)

(73) Assignee: Eiko Epson Corporation, Tokyo (JP)

( * ) Notice: Subject to any disclaimer, the term of this patent is extended or adjusted under 35 U.S.C. 154(b) by 0 days.

(21) Appl. No.: 09/101,882

(22) PCT Filed: Nov. 14, 1997

(86) PCT No.: PCT/JP97/04150

§ 371 Date: Nov. 9, 1998

§ 102(e) Date: Nov. 9, 1998

(87) PCT Pub. No.: WO98/22288

PCT Pub. Date: May 28, 1998

(30) Foreign Application Priority Data

Nov. 18, 1996 (JP) ..... 8-322345

(51) Int. Cl.[7] ..... B41J 2/045
(52) U.S. Cl. ..... 347/70; 347/65
(58) Field of Search ..... 347/68, 70, 71, 347/15, 40, 47, 65

(56) References Cited

U.S. PATENT DOCUMENTS

| | | | | |
|---|---|---|---|---|
| 4,924,241 | * | 5/1990 | Parko et al. | 347/54 |
| 5,208,605 | * | 5/1993 | Drake | 347/15 |
| 5,412,410 | * | 5/1995 | Rezanka | 347/15 |
| 5,424,769 | * | 6/1995 | Sakai et al. | 347/70 |
| 5,828,390 | * | 10/1998 | Thiel | 347/40 |
| 5,880,763 | * | 3/1999 | Tanaka et al. | 347/70 |
| 5,907,339 | * | 5/1999 | Evans et al. | 347/54 |
| 6,036,302 | * | 3/2000 | Hotomi | 347/55 |
| 6,042,219 | * | 3/2000 | Hugashino et al. | 347/47 |
| 6,070,972 | * | 6/2000 | Thiel | 347/71 |
| 6,086,189 | * | 7/2000 | Hosono et al. | 347/70 |

FOREIGN PATENT DOCUMENTS

| | | | | |
|---|---|---|---|---|
| 58-40509 | | 3/1983 | (JP) | G02B/7/26 |
| 61-193859 | | 8/1986 | (JP) | B41J/3/04 |
| 1242259 | * | 9/1989 | (JP) | 347/15 |
| 5-309835 | | 11/1993 | (JP) | B41J/2/045 |
| 7-60957 | | 3/1995 | (JP) | B41J/2/045 |
| 7-156383 | | 6/1995 | (JP) | B41J/2/045 |
| 9-174830 | | 7/1997 | (JP) | B41J/2/045 |

OTHER PUBLICATIONS

International Search Report.

* cited by examiner

*Primary Examiner*—Benjamin R. Fuller
*Assistant Examiner*—C. Dickens
(74) *Attorney, Agent, or Firm*—Sughrue, Mion, Zinn, Macpeak & Seas, PLLC

(57) ABSTRACT

An ink-jet printing head according to the present invention is constituted so that two reservoirs 3 and 4 are formed with each pressure generating chamber 2 between the two reservoirs, the pressure generating chamber 2 communicates with at least one reservoir 3 or 4 via an ink supply port 5 or 6, adjacent nozzle communicating holes are arranged in approximately opposite positions with the center in the longitudinal direction of the pressure generating chamber 2 between the adjacent nozzle communicating holes and arranged zigzag with the adjacent nozzle communicating holes shifted in the longitudinal direction of the pressure generating chamber 2 and the height M of a partition for partitioning the nozzle communicating hole 7 or 8 which is a through hole and the adjacent pressure generating chamber 2 is approximately equal to the height of a partition N between the pressure generating chambers 2. Hereby, even if the pressure generating chambers are arranged in high density, crosstalk caused by the partition for partitioning the nozzle communicating hole and the adjacent pressure generating chamber can be prevented.

18 Claims, 13 Drawing Sheets

INK-JET PRINTING HEAD FOR PREVENTING CROSSTALK

This application claims benefit from PCT International Application No. PCT/JP97/04150.

BACKGROUND OF THE INVENTION

1. Field of the Invention

The present invention relates to an ink-jet printing head, more particularly relates to a method of producing a flow passage forming substrate.

2. Description of the Related Art

In an ink-jet printing head, as shown in FIG. 13, a flow passage unit is constituted by a flow passage forming substrate F in which a reservoir A to which ink is supplied from an outside tank, a pressure generating chamber B which is concave and pressurized from the outside, an ink supply port C connecting the reservoir A and the pressure generating chamber B and a nozzle communicating hole E which is a through hole and connects the pressure generating chamber B and a nozzle aperture D are formed, an elastic plate G for sealing one surface of the flow passage forming substrate F and a nozzle plate H provided with the nozzle aperture D for sealing the other surface of the flow passage forming substrate F. The ink-jet printing head is constituted so that ink in the reservoir A is sucked in the pressure generating chamber B via the ink supply port C by touching a piezoelectric vibrator J to the elastic plate G and expanding the pressure generating chamber B by the displacement of the piezoelectric vibrator J and an ink droplet ejects from the nozzle aperture D by pressurizing ink the pressure generating chamber B by contracting the pressure generating chamber B.

As in such an ink-jet printing head, full color printing can be readily executed by using color ink, the ink-jet printing head is rapidly popularized as a printing head of a color printer and hereby, it is demanded that printing quality and density are further enhanced.

As the printing quality and density of an ink-jet printing head greatly depend upon the size of a dot which an ink droplet forms, it is required to reduce the quantity of ink per droplet as much as possible to miniaturize the size of a dot.

Therefore, the volume of a pressure generating chamber can be reduced as much as possible and, in addition, pressure generating chambers can be arrayed in high density by arraying pressure generating chambers in high density, selecting a substrate 300 $\mu$m or more thick, desirably a substrate approximately 500 $\mu$m thick, for example a monocrystalline silicon substrate in view of working precision as a flow passage forming substrate in consideration of preventing a flow passage forming substrate from being deformed by pressure when an ink droplet ejects and, further, facility in handling in assembly and forming the pressure generating chamber as a shallow concave portion by photolithography and anisotropic etching as disclosed in Unexamined Japanese Patent Application No. Sho. 58-40509.

When the pressure generating chamber is constituted on one surface of the substrate as a concave portion as described above, the nozzle communicating hole E for connecting the pressure generating chamber and the nozzle aperture is required to let the pressure generating chamber communicate with the nozzle aperture D of the nozzle plate arranged on the surface on the side reverse to the surface on which the pressure generating chamber is formed.

Such a nozzle communicating hole E is formed by making a through hole with a minute diameter pierced from one surface to the other surface in an area to be the nozzle communicating hole E beforehand as disclosed in Unexamined Japanese Patent Application No. Sho. 5-309835 and executing anisotropic etching to the depth using the above through hole as an etching pilot hole so that the width of the nozzle communicating hole E is approximately equal to the width of the pressure generating chamber B at the maximum.

Therefore, as shown in FIG. 14, as the height of a partition in an area K' which faces the nozzle communicating hole E is equal to the thickness d' of the monocrystalline silicon substrate and large though the partition in the vicinity of the pressure generating chamber is provided with high rigidity because the depth d of the pressure generating chamber B is small in an area K in the vicinity of the pressure generating chamber of partitions for partitioning the pressure generating chambers B, the rigidity of the partition between the adjacent nozzle communicating holes E is extremely small and there is a problem that pressure when ink is jetted elastically deforms the area K' and crosstalk is caused between the adjacent pressure generating chambers B.

SUMMARY OF THE INVENTION

An ink-jet printing head according to the present invention is provided with a flow passage forming substrate in which a pressure generating chamber, a reservoir, an ink supply port and a nozzle communicating hole which is a through hole are formed, a nozzle plate provided with a nozzle communicating with the pressure generating chamber via the nozzle communicating hole, a capping member for sealing the side of the pressure generating chamber of the flow passage forming substrate and pressure generating means for pressurizing the pressure generating chamber, two reservoirs are formed with the pressure generating chamber held between the two reservoirs, the pressure generating chamber communicates with at least one reservoir of them via the ink supply port, and the nozzle communicating holes are arranged zigzag in an approximately symmetrical position in which the center in the longitudinal direction of the pressure generating chamber is held between the adjacent nozzle communicating holes and so that one of the adjacent nozzle communicating holes is shifted in the longitudinal direction of the pressure generating chamber.

Hereby, as the height of a partition for partitioning the nozzle communicating hole which is a through hole and the adjacent pressure generating chamber is approximately equal to the height of a partition between the pressure generating chambers, the flow passage forming substrate can be provided with sufficient rigidity. Therefore, even if the pressure generating chambers are arrayed in high density, a piezoelectric vibrator smaller than the outside diameters of a diaphragm may be used and crosstalk can be prevented.

DESCRIPTION OF THE PREFERRED EMBODIMENTS

Figure 1:
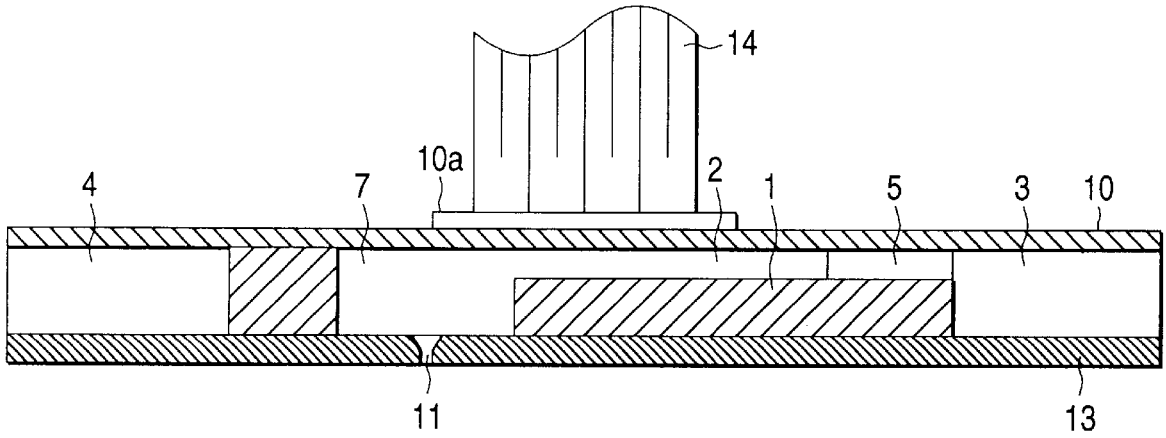
FIGS. 1(*a*) and 1(*b*) show an embodiment of an ink-jet printing head according to the present invention as the sectional structure viewed along a center line between adjacent pressure generating chambers.
Figure 1:
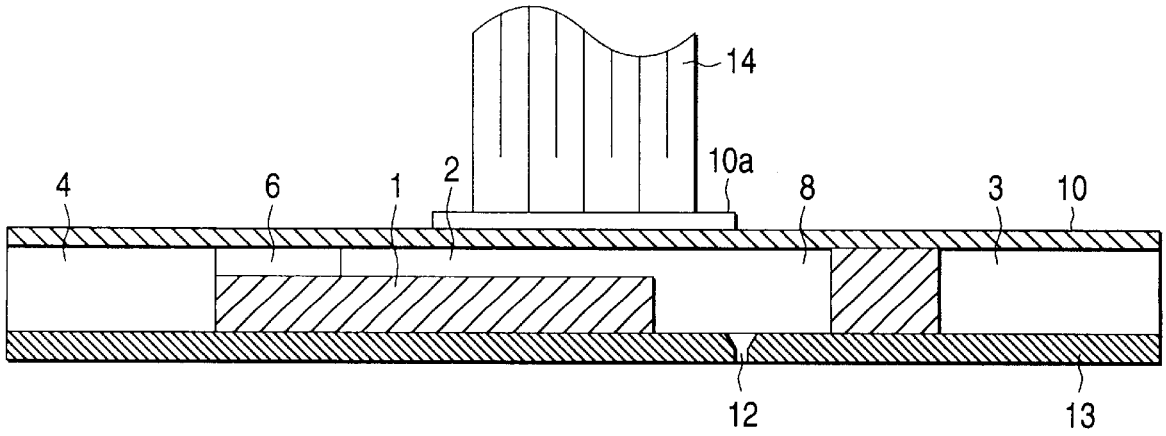

The present invention will be described in detail based upon embodiments shown in the drawings below.

FIGS. 1(*a*) and 1(*b*) show an embodiment of the present invention as the sectional structure viewed along a center line (a line A—A and a line B—B in FIG. 2) between adjacent pressure generating chambers 2, a flow passage forming substrate 1 is made of a monocrystalline silicon substrate in this embodiment, a pressure generating chamber 2 is formed by anisotropic half-etching as a shallow concave portion, and a first reservoir 3 and a second reservoir 4 are also formed by anisotropic etching in two columns as a through hole in this embodiment on both sides of each pressure generating chamber 2. Each pressure generating chamber 2 adjacent in a row communicates with the first reservoir 3 or the second reservoir 4 via an ink supply port 5 or 6 which is a concave portion with depth approximately equal to the depth of the pressure generating chamber 2.

Figure 2:
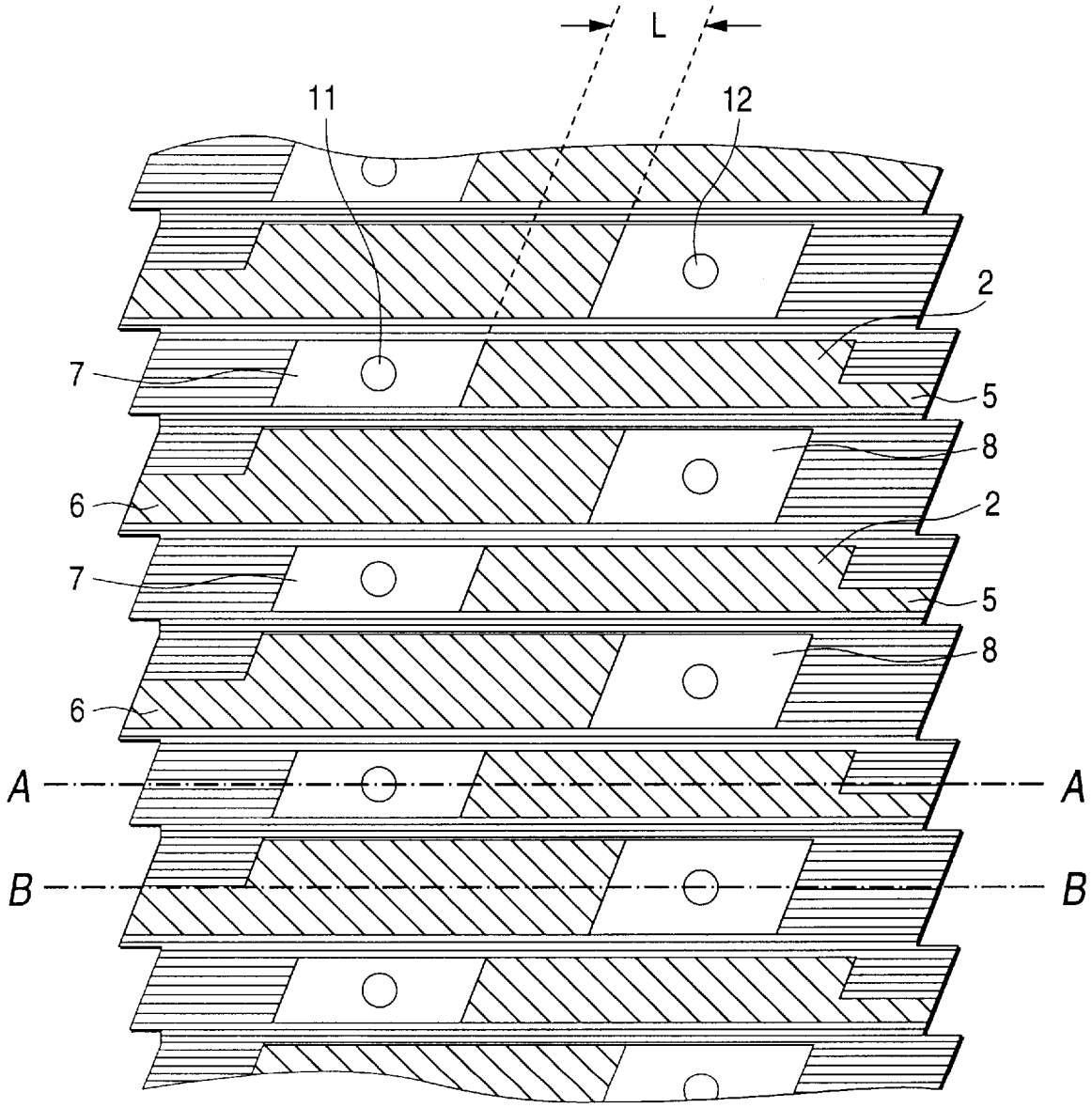
FIG. 2 is a top view showing an embodiment of a flow passage forming substrate in the above ink-jet printing head by enlarging the vicinity of an ink supply port, a pressure generating chamber and a nozzle communicating hole

At the end on the side on which the ink supply port 5 or 6 is not formed, a nozzle communicating hole 7 or 8 pierced from the pressure generating chamber 2 to the other surface, that is, to the surface of a nozzle plate 13 is formed. In FIG. 2, zigzag hatching shows an area which is not etched, oblique hatching shows a half-etched area and further, an area which is not hatched shows a through hole.

The surface on the side of the pressure generating chamber of the spacer 1 constituted as described above is sealed by an elastic plate 10, the other surface is sealed by a nozzle plate 13 in which a nozzle aperture 11 or 12 is made in an area opposite to each nozzle communicating hole 7 or 8 and a flow passage unit is composed of the above members.

In each pressure generating chamber 2, pressure generating means, a piezoelectric vibrator 14 in a longitudinal vibration mode which is pressure generating means in the present embodiment is provided in an approximately central area on the center line A—A or B—B between the pressure generating chambers 2 on the elastic plate 10 with the end of the piezoelectric vibrator in contact with an island part 10*a* formed on the elastic plate 10 and with the other end fixed to a head frame not shown which also functions as a fixing member. The piezoelectric vibrators 14 which respectively function as pressure generating means are arranged by the number of the pressure generating chambers 2 in the row of the pressure generating chambers 2.

In this embodiment, when a driving signal is applied to the piezoelectric vibrator 14, the piezoelectric vibrator 14 is contracted and the pressure generating chamber 2 is expanded. Ink in the first or second reservoir 3 or 4 flows into the pressure generating chamber 2 via the ink supply port 5 or 6 because of the above expansion.

Next, when the charges of the piezoelectric vibrator 14 are discharged, the piezoelectric vibrator 14 expands to an original state and compresses the pressure generating chamber 2. Hereby, pressurized ink is jetted as an ink droplet from the nozzle aperture 11 or 12 via the nozzle communicating hole 7 or 8.

Figure 3:
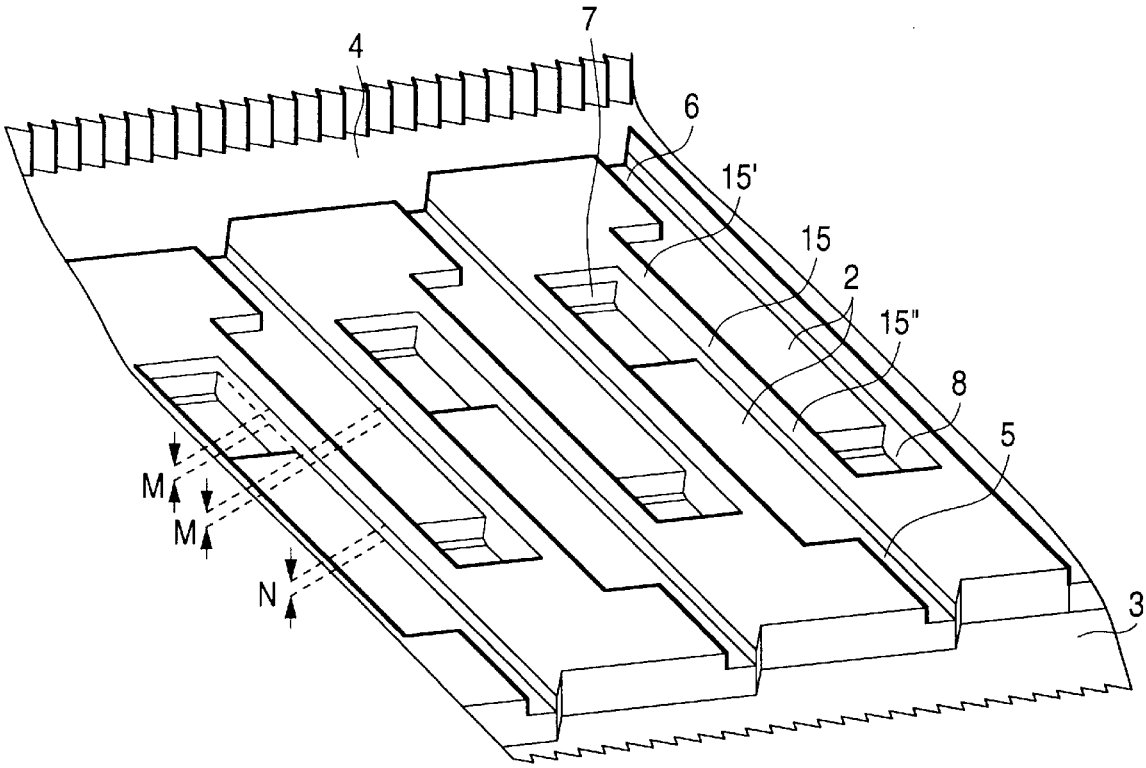
FIG. 3 is a perspective drawing showing the vicinity of a reservoir, the ink supply port, the pressure generating chamber and the nozzle communicating hole in the flow passage forming substrate of the above ink-jet printing head by enlarging the above vicinity.

In this embodiment, as the nozzle communicating holes 7 and 8 of adjacent pressure generating chambers 2 are arranged at least at an interval L shown in FIG. 2 in the longitudinal direction of the pressure generating chamber 2 and the height M of areas 15' and 15" respectively opposite to the nozzle communicating holes 7 and 8 of a partition 15 for partitioning adjacent pressure generating chambers 2 as shown in FIG. 3 is equal to the depth N of each pressure generating chamber 2 and shallow, the areas 15' and 15" are provided with sufficient rigidity approximately equal to the rigidity of the partition 15 partitioning adjacent pressure generating chambers 2. Therefore, the areas 15' and 15", adjacent to each nozzle communicating hole 7 or 8 of the partition 15 are never deformed by pressure when ink is jetted and crosstalk is prevented.

As the nozzle apertures 11 and 12 which respectively communicate with adjacent pressure generating chambers 2 can be arranged at an interval in the longitudinal direction of the pressure generating chamber 2, the degree of freedom is enhanced in the layout of nozzle apertures and distortion when the nozzle plate 13 is pressed can be dispersed.

Figure 4:
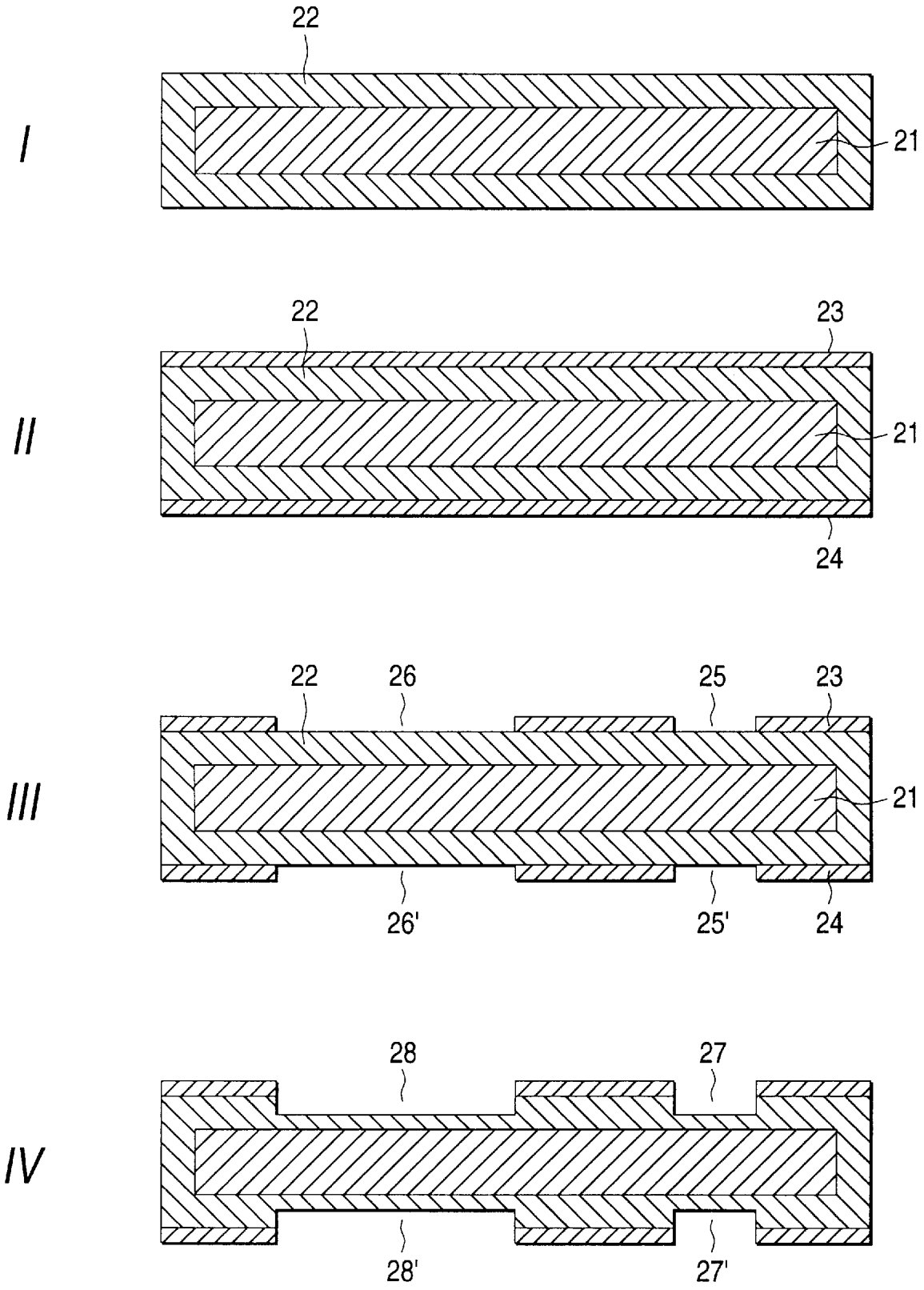
FIGS. 4I–4IV 5 and 6I–6IV respectively show an embodiment in case the flow passage forming substrate according to the present invention is manufactured by anisotropic etching using a monocrystalline silicon substrate.
Figure 5:
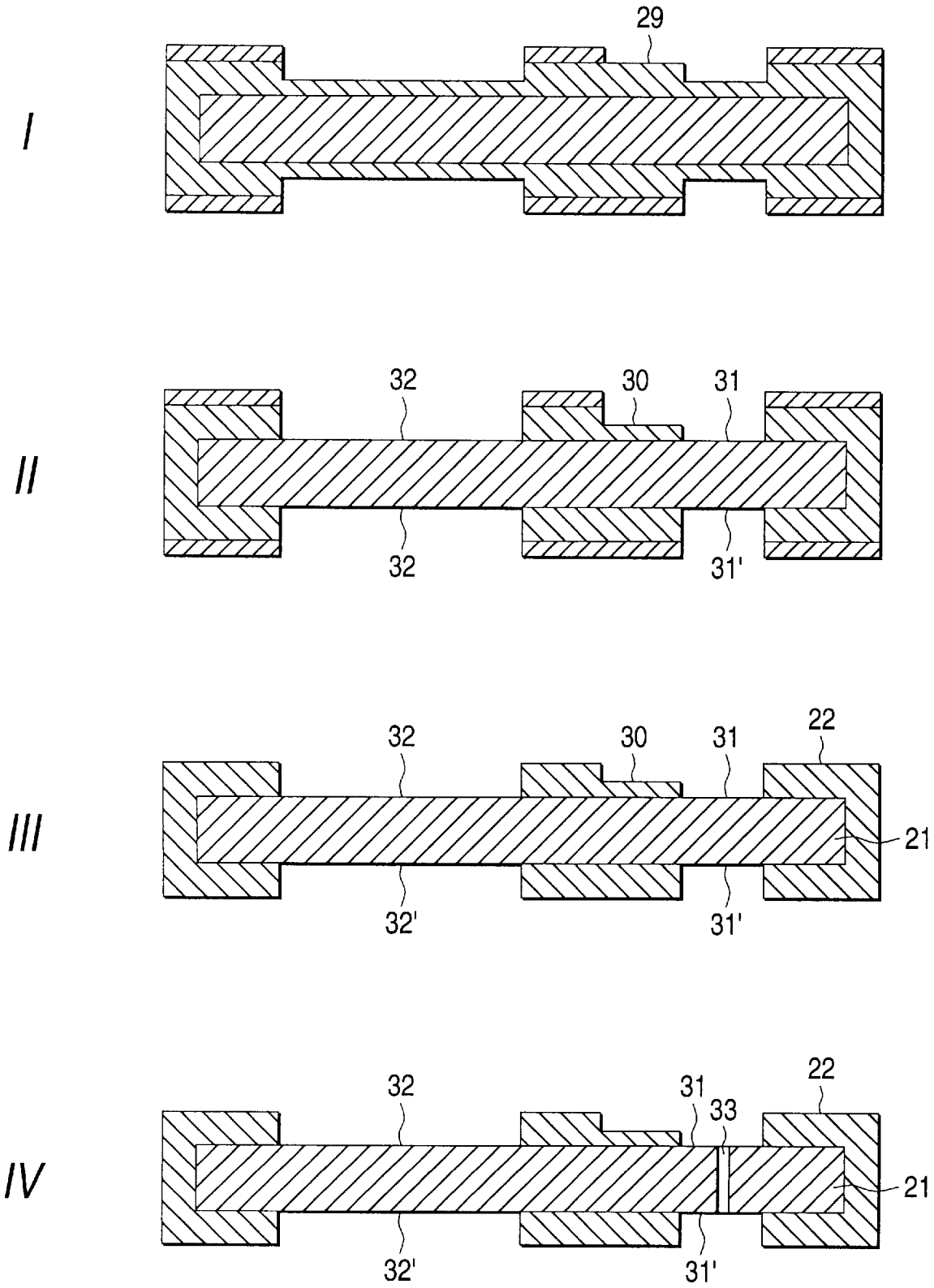
Figure 6:
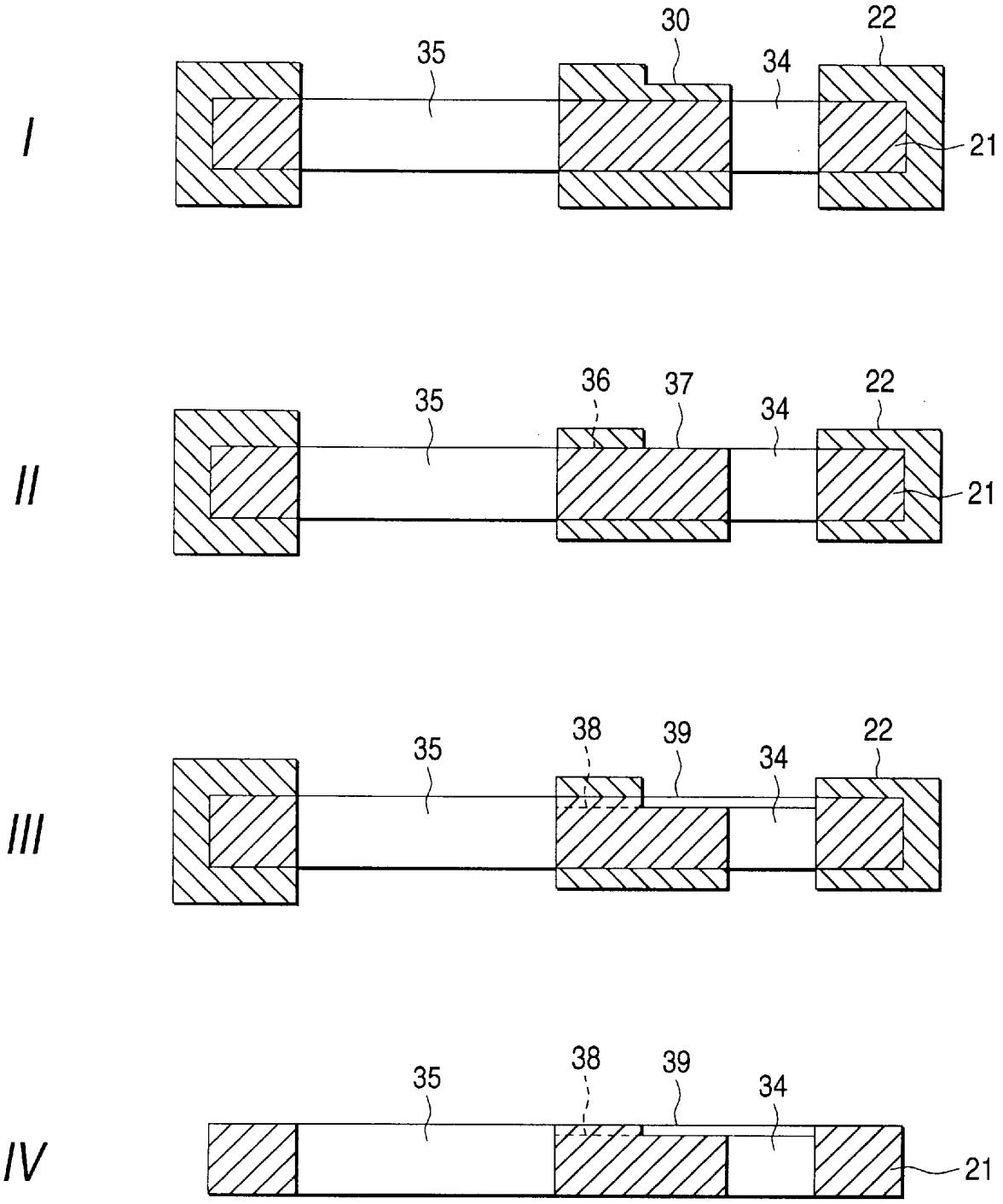

FIGS. 4 to 6 show a method of manufacturing the above flow passage forming substrate, taking a case that one reservoir and one nozzle communicating hole are formed as an example and a silicon oxide film 22 which functions as a film for protecting from etching is formed on the whole surface of a monocrystalline silicon substrate 21 with thickness easy to handle, for example the thickness of approximately 500 $\mu$m and the orientation of a crystal plane of (110) by thermal oxidation so that the silicon oxide film has predetermined thickness, for example, is 1 $\mu$m thick. As for the film for protecting from etching, if a substance provided with corrosion resistance to anisotropic etchant is formed as a film such as a silicon nitride film and a metallic film as shown in FIG. 4(I), the similar action as a film for protecting from etching is produced.

Next, a photoresist is applied uniformly on both surfaces of the silicon oxide film 22 by spinning and others to form photoresist layers 23 and 24 as shown in FIG. 4(II) and resist patterns 25, 25', 26 and 26' to be the pressure generating chamber 2 and the reservoir 3 are formed on both sides by photolithography as shown in FIG. 4(III).

Patterns 27, 27', 28 and 28' respectively corresponding to the resist patterns 25, 25', 26 and 26' are transferred as a result of half-etching the silicon oxide film 22 by dipping the monocrystalline silicon substrate 21 in buffer hydrofluoric solution as shown in FIG. 4(IV).

Next, a pattern 29 for an ink supply port is formed on one surface by exposing and developing areas to be the ink supply ports 5 and 6 and the pressure generating chamber 2 as shown in FIG. 5(I) and the monocrystalline silicon substrate 21 is etched by dipping the monocrystalline silicon substrate in buffer hydrofluoric solution again until the patterns 27, 27', 28 and 28' of the silicon oxide film formed in the above process shown in FIG. 4(IV) disappear as shown in FIG. 5(II). Hereby, a pattern 30 of the silicon oxide film is left and patterns 31, 31', 32 and 32' for anisotropic etching respectively corresponding to the pressure generating chambers 2 and the reservoirs 3 and 4 are formed on both sides.

After unnecessary photoresist layers 33 and 34 are peeled as shown in FIG. 5(III), an etching pilot hole 33 with depth to the extent that etching can reach the other surface from one surface of the patterns 31 and 31' to be the approximately parallelogrammatic pressure generating chamber 2 is made desirably in the center of the pattern 31 by irradiating a laser beam with wavelength suitable for boring the monocrystalline silicon substrate 21, for example a YAG laser beam as shown in FIG. 5 (IV).

When boring operation is finished, the monocrystalline silicon substrate 21 is dipped in the aqueous solution of potassium hydroxide (KOH) of 20 percent by weight kept approximately 80° C. for anisotropic etching. A reservoir 35 is formed by a monocrystalline silicon plane (111) with an angle θ to the surface of the monocrystalline silicon substrate 21 by the above anisotropic etching.

An area in which the patterns 31 and 31' for the nozzle communicating holes 7 and 8 are formed is etched in the range of the patterns 31 and 31' in the direction of the thickness, being guided by the etching pilot hole 33 and finally, a through hole with predetermined cross section is formed as shown in FIG. 6(I).

Next, after concave patterns 36 and 37 to be the ink supply ports 5 and 6 and the pressure generating chamber 2 are formed as shown in FIG. 6(II), anisotropic etching is executed as shown in FIG. 6(III) until the above patterns become concave portions 38 and 39 with depth suitable for the ink supply ports 5 and 6 and the pressure generating chamber 2 and finally, when the silicon oxide film 22 is removed by etching, a flow passage forming substrate is completed as shown in FIG. 6(IV).

Figure 7:
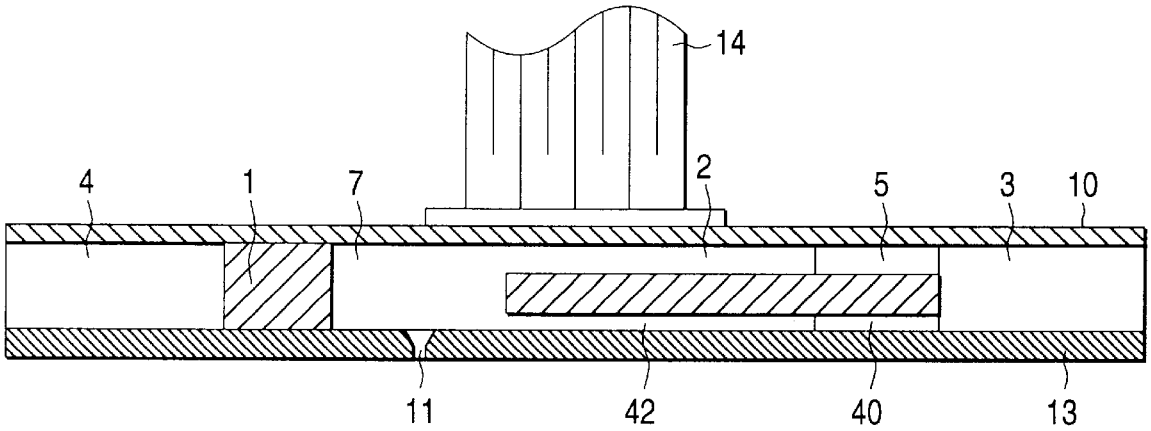
FIGS. 7(*a*) and 7(*b*) show another embodiment of the ink-jet printing head according to the present invention as the sectional structure viewed along a center line between adjacent pressure generating chambers.
Figure 7:
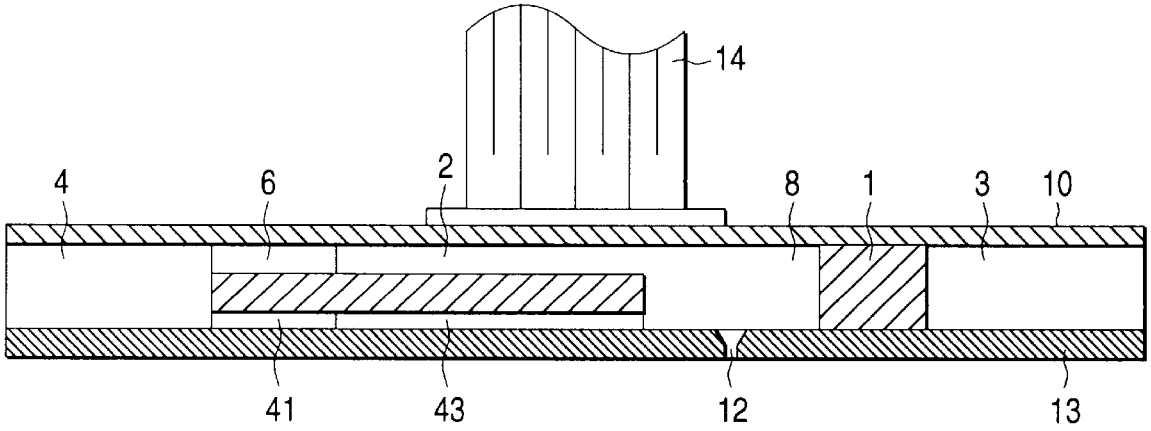

In the above embodiment, the ink supply ports 5 and 6 are formed only on the side of the elastic plate 10, however, when a second ink supply port 40 or 41 and a second pressure generating chamber 42 or 43 communicating with the above ink supply port 40 or 41 and the nozzle communicating hole 7 or 8 is formed on the side of the nozzle plate 13 as shown in FIGS. 7(*a*) and 7(*b*), ink in the reservoir 3 or 4 can be supplied to the pressure generating chamber 2 via the two ink supply ports 5 and 40 or 6 and 41. Hereby, time required for supplying ink to the pressure generating chamber 2 is reduced and the printing head can be driven at high speed.

Figure 8:
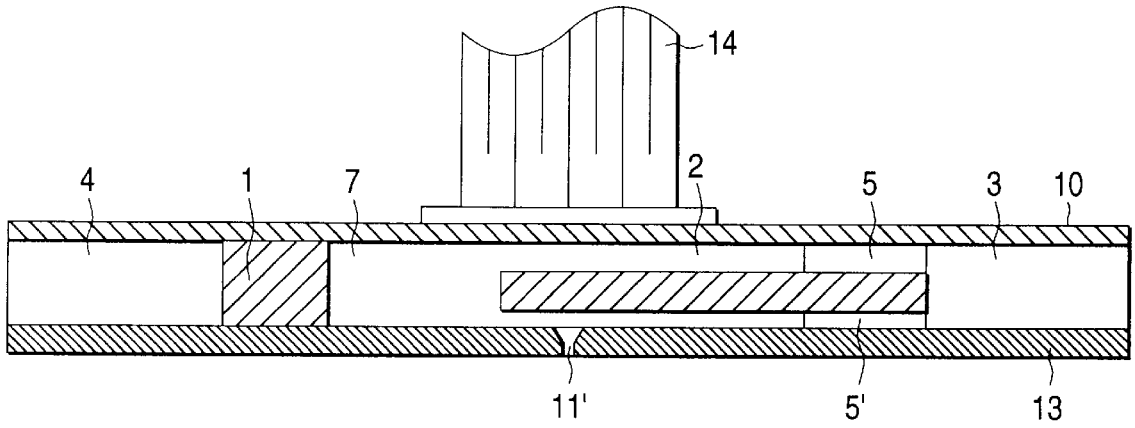
FIGS. 8(*a*) and 8(*b*) show further another embodiment of the ink-jet printing head according to the present invention as the sectional structure viewed along a center line between adjacent pressure generating chambers.
Figure 8:
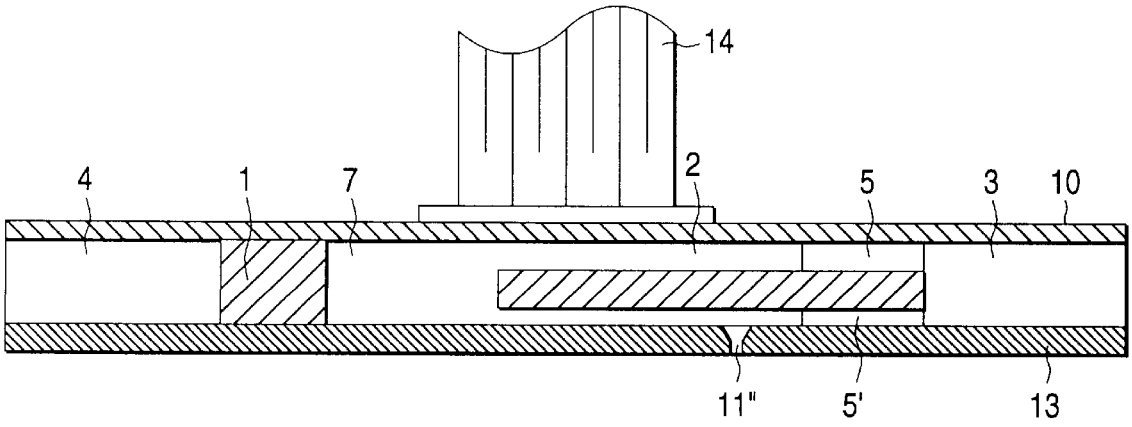

According to this embodiment, as shown in FIGS. 8(*a*) and 8(*b*), not only the nozzle aperture 11 or 12 is formed in a position opposite to the nozzle communicating hole 7 or 8 but a nozzle aperture 11' or 11" is formed in an area opposite to the second pressure generating chamber 42 or 43 and ink pressurized in the pressure generating chamber 2 can be jetted as an ink droplet.

Figure 9:
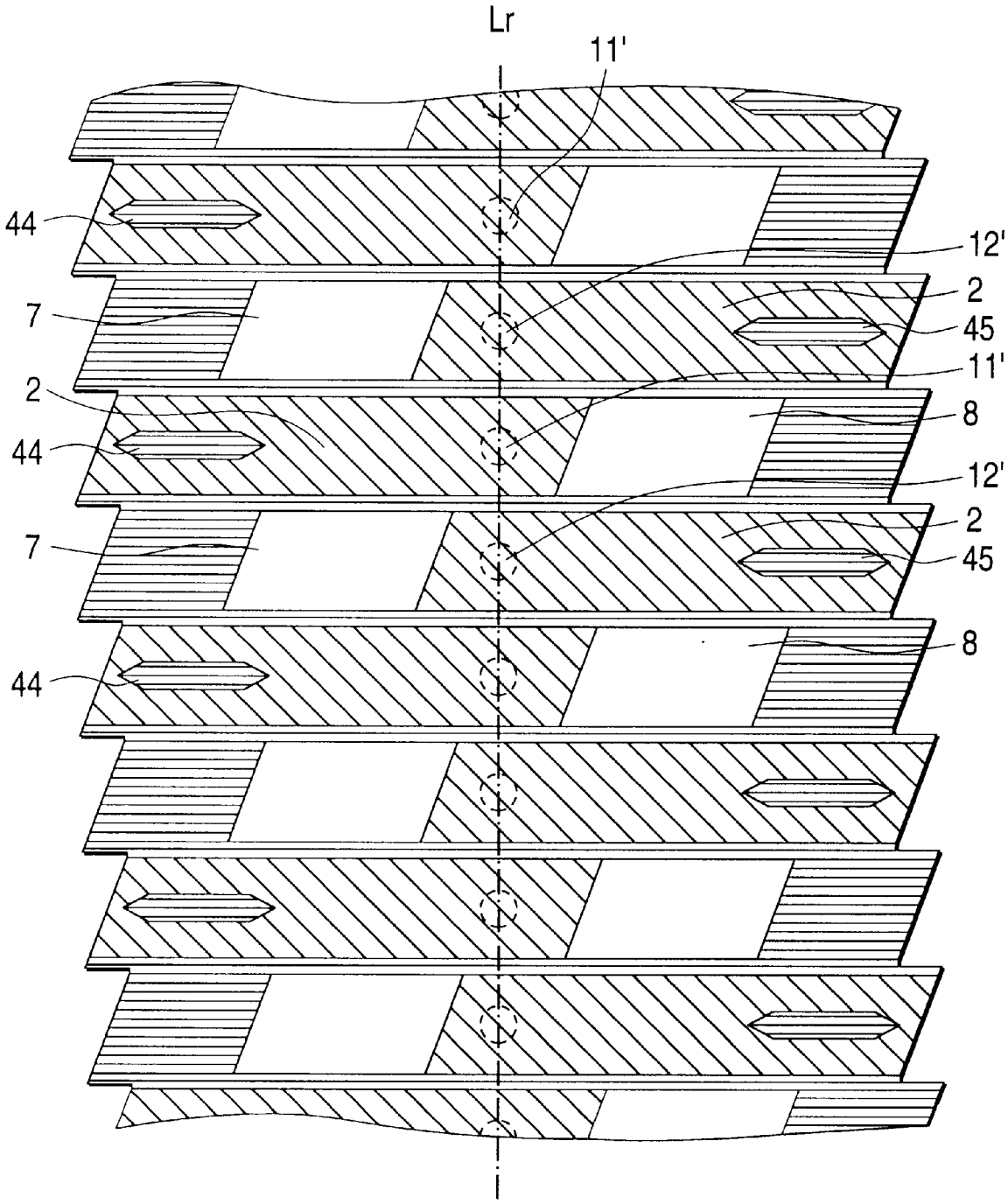
FIG. 9 is a top view showing the arrangement of nozzle apertures which may be applied to the ink-jet printing head shown in FIGS. 8 in relationship between the arrangement of nozzle apertures and the flow passage forming substrate.

Hereby, if each pressure generating chamber 2 is alternately arranged in a different direction as shown in FIG. 9, the nozzle apertures 11' and 12' can be also arranged on the same line Lr and timing when an ink droplet is jetted can be simplified.

In the above embodiment, the ink supply port 5 or 6 is formed with the width at the end of the pressure generating chamber 2 narrowed, however, as shown in FIG. 9, a part not etched 44 or 45 may be also provided on the side of the reservoir in the pressure generating chamber 2 to adjust resistance in a passage.

Figure 10:
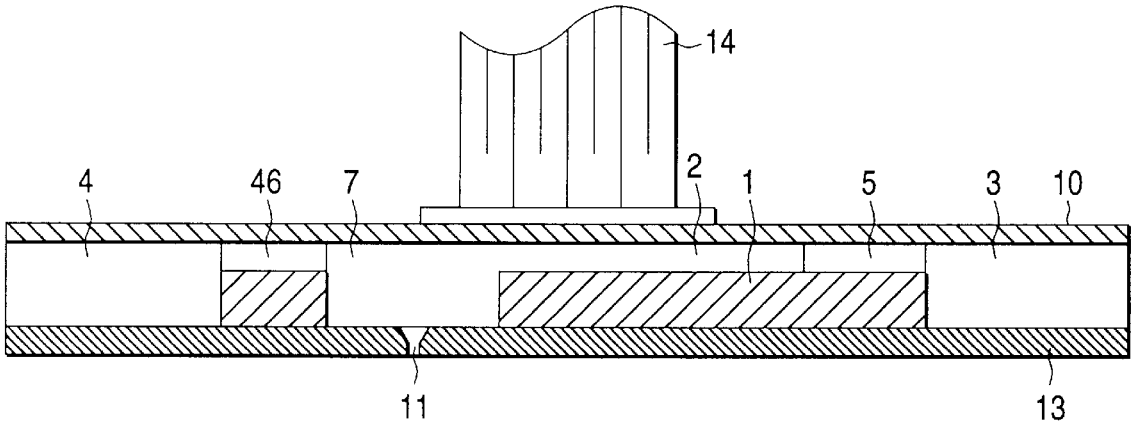
FIGS. 10(*a*) and 10(*b*) each shows the other embodiment of the ink-jet printing head according to the present invention as the sectional structure viewed along a center line between adjacent pressure generating chambers.
Figure 10:
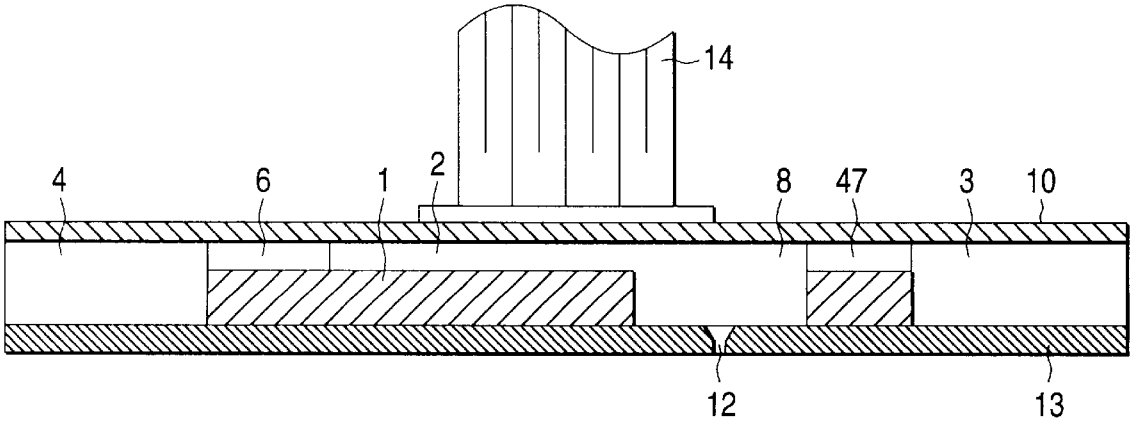

Also, in the above embodiment, the ink supply port 5 or 6 is formed at one end on the side apart from the nozzle aperture 11 or 12 in the pressure generating chamber 2 and ink is supplied from one side, however, first and second ink supply ports 5 and 46 or 6 and 47 may be also formed on both sides of each pressure generating chamber 2 as shown in FIG. 10 so that the two ink supply ports respectively communicate with the two reservoirs 3 and 4 arranged with the pressure generating chamber 2 between the two reservoirs.

Figure 11:
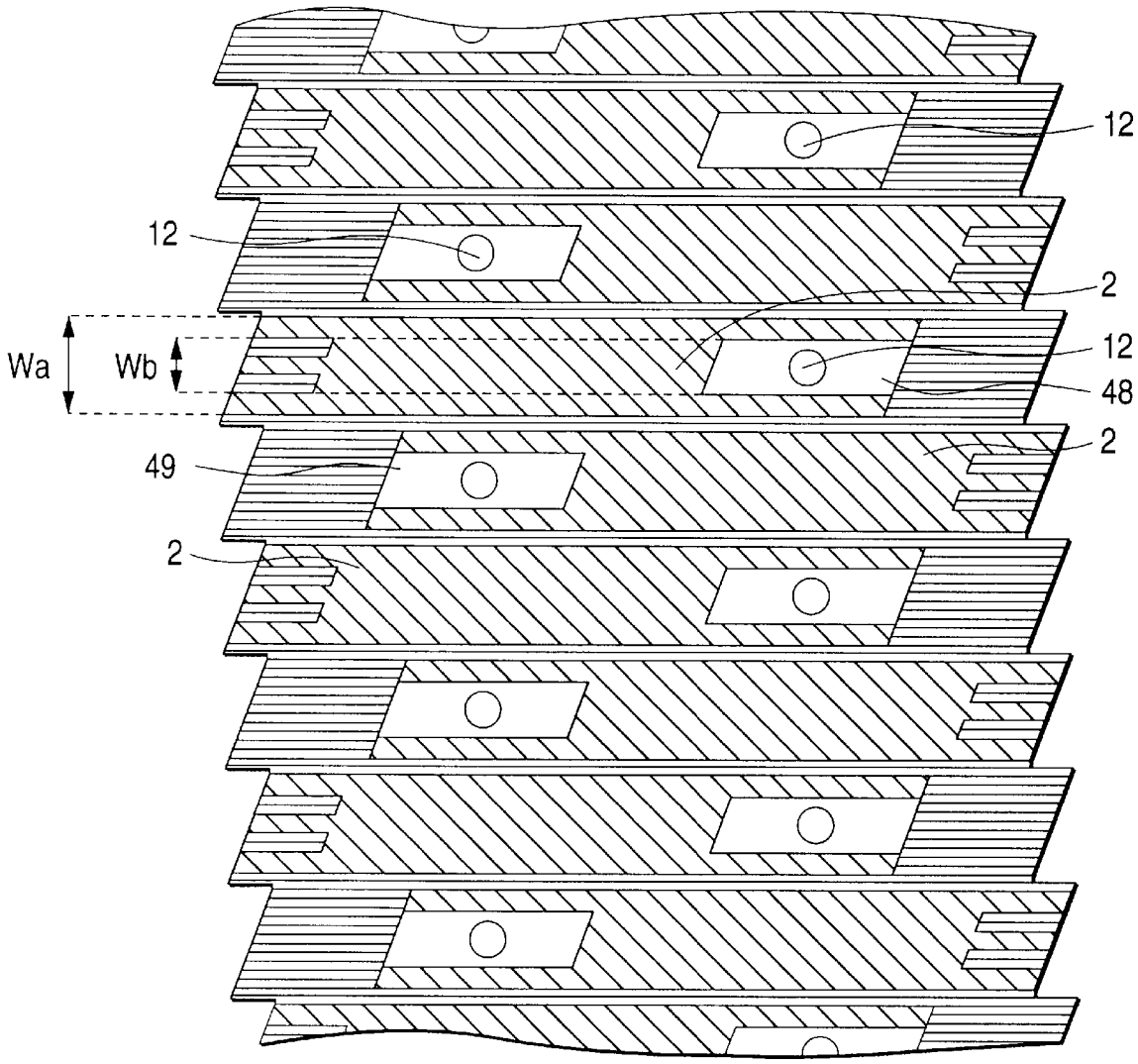
FIG. 11 is a top view showing another embodiment of the flow passage forming substrate used for the ink-jet printing head according to the present invention.

Further, in the above embodiment, the nozzle communicating hole 7 and the pressure generating chamber 2 are formed so that they have the same width, however, even if a nozzle communicating hole 48 or 49 with width Wb narrower than the width Wa of the pressure generating chamber 2 is formed as shown in FIG. 11, the similar action is produced. In FIG. 11, zigzag hatching shows an area which is not etched, oblique hatching shows a half-etched area and further, an area which is not hatched shows a through hole.

Figure 12:
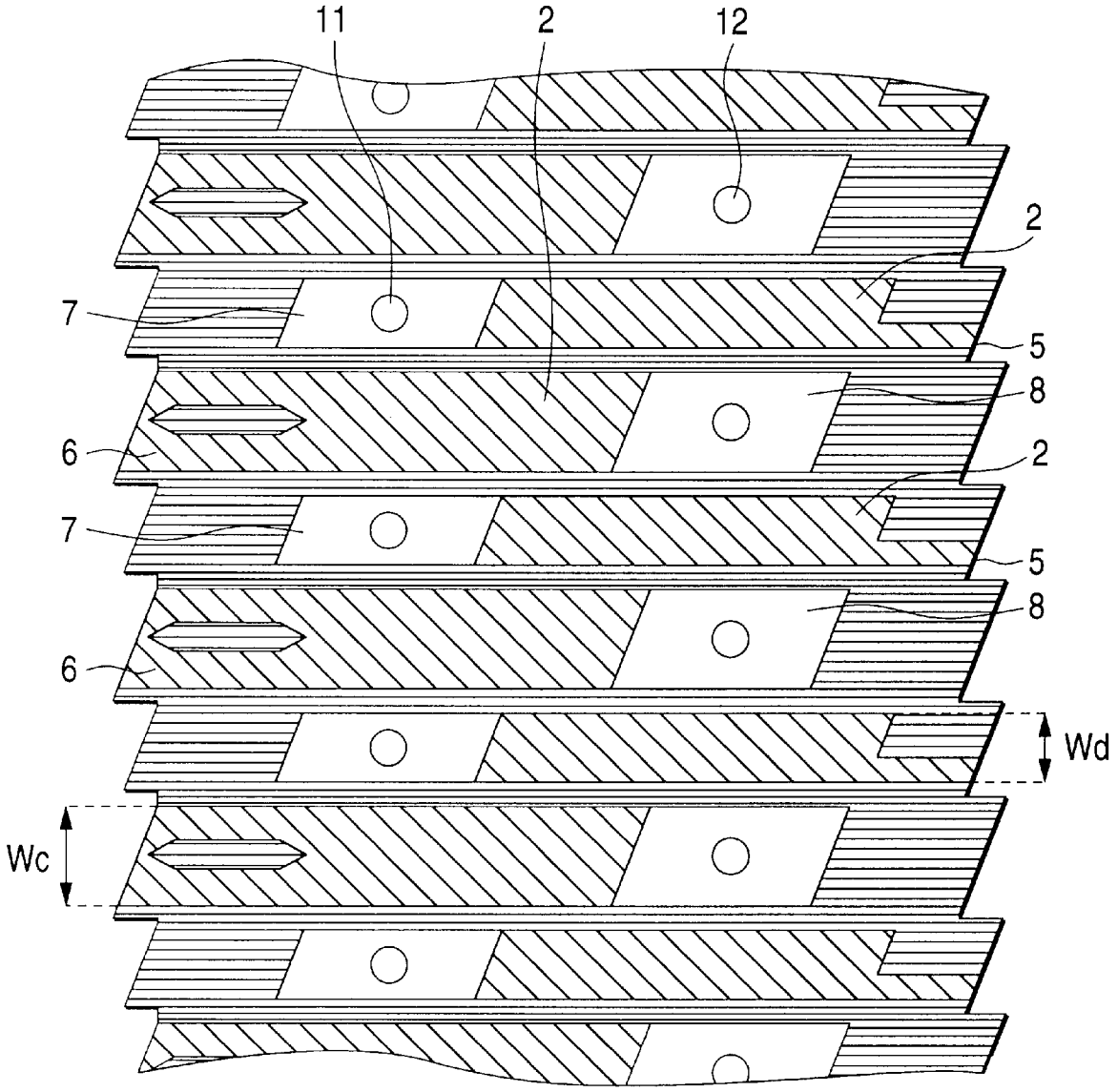
FIG. 12 is a top view showing the other embodiment of the flow passage forming substrate used for the ink-jet printing head according to the present invention.
Figure 13:
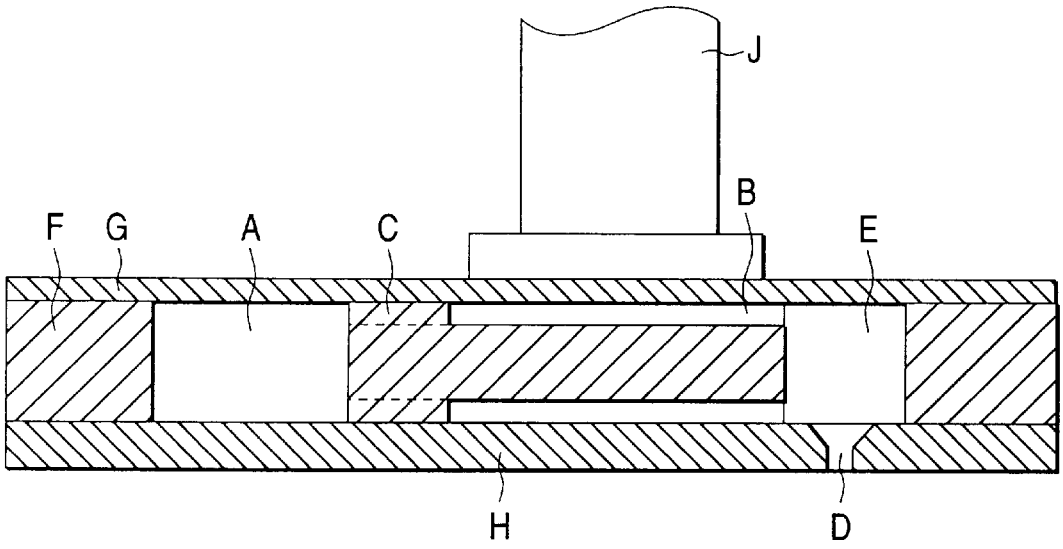
FIG. 13 shows an example of a conventional type ink-jet printing head.
Figure 14:
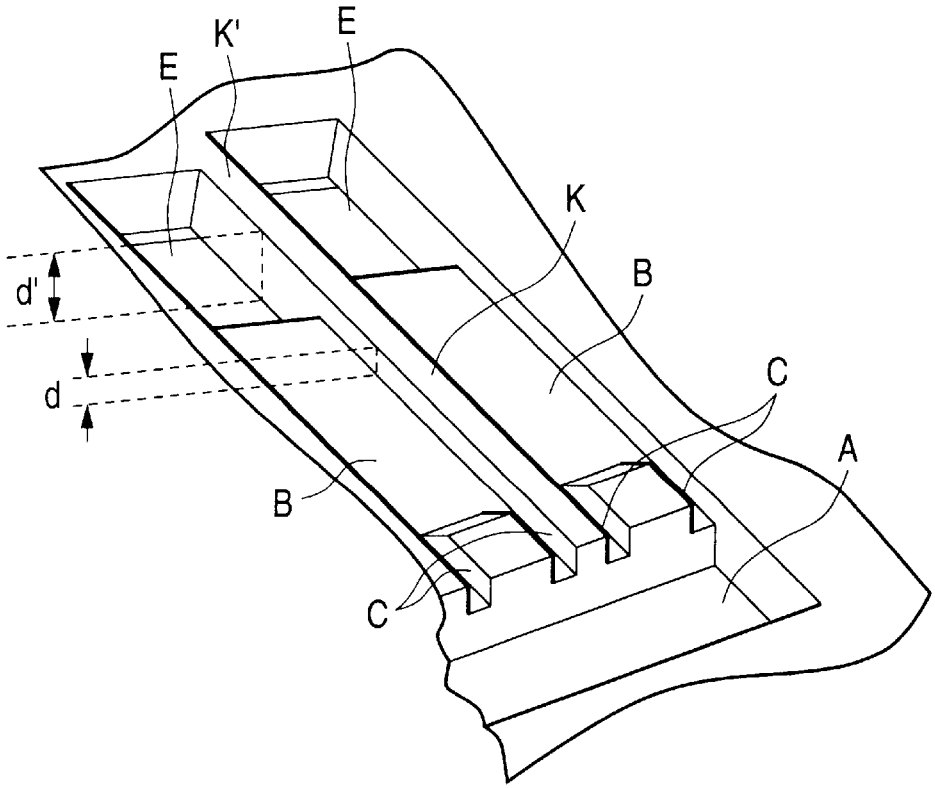
FIG. 14 is a perspective drawing showing an example of a flow passage forming substrate in the conventional type ink-jet printing head.

Furthermore, in the above embodiment, the width of the pressure generating chambers 2 alternately arranged in a reverse direction is equalized, however, as ink droplet jetting performance can be changed by making a difference between the width Wc and Wd of the pressure generating chambers 2 different in a direction as shown in FIG. 12, the width suitable for the viscosity and property of ink can be selected, each ink droplet of different types of ink in one printing head, for example each ink droplet of black ink and color ink or each ink droplet of different colors of ink can be adjusted in size suitable for printing and the degree of freedom of usable ink can be enhanced.

In the above embodiment, the flow passage forming substrate is processed by anisotropically etching a monocrystalline silicon substrate in which a concave portion and a through hole can be formed precisely, however, as it is clear that the strength of the partition in the vicinity of the nozzle communicating hole can be also enhanced if the flow passage forming substrate is formed by boring a thin plate made of metal, ceramics or glass or by the injection molding of polymeric material, the similar action is also produced in case the flow passage forming substrate is formed by material except a monocrystalline silicon substrate.

As described above, as in an ink-jet printing head according to the present invention, the two reservoirs are formed with the pressure generating chamber between them, the pressure generating chamber communicates with at least one reservoir via the ink supply port and adjacent nozzle communicating holes are arranged in approximately opposite positions with the center in the longitudinal direction of the pressure generating chamber between the adjacent nozzle communicating holes and arranged zigzag with the adjacent nozzle communicating holes shifted in the longitudinal direction of the pressure generating chamber, the height of the partition for partitioning the nozzle communicating hole which is a through hole and the adjacent pressure generating chamber is approximately equal to the height of the partition between the adjacent pressure generating chambers and rigidity enough to prevent crosstalk can be kept.

As the nozzle apertures can be arranged in different positions in the longitudinal direction of the pressure generating chamber, the degree of freedom of the position of the nozzle aperture is high and distortion when the nozzle plate is added can be dispersed.

What is claimed is:

1. An ink-jet printing head comprising a flow passage forming substrate made of a plate in which pressure generating chambers, reservoirs, ink supply ports and nozzle communicating holes are formed, a nozzle plate provided with nozzles communicating with said pressure generating chambers by way of said nozzle communicating holes and pressure generating means for pressurizing said pressure generating chambers, wherein:

each of said pressure generating chambers is formed between adjacent reservoirs;

each of said pressure generating chambers communicates with said adjacent reservoirs by way of said ink supply ports; and adjacent nozzle communicating holes of said nozzle communicating holes are arranged in opposite positions in a longitudinal direction with respect to said pressure generating chambers so as to be formed in a staggered pattern.

2. An ink-jet printing head according to claim 1, wherein: said ink supply ports are formed on the side on which said pressure generating chambers are formed.

3. An ink-jet printing head according to claim 1, wherein: said ink supply ports are formed on the sides of said capping member and said nozzle plate.

4. An ink-jet printing head according to claim 1, wherein: said ink supply ports are formed at both ends of said pressure generating chambers.

5. An ink-jet printing head according to claim 1, wherein: said nozzle communicating holes are formed so that the width is narrower than the width of said pressure generating chambers.

6. An ink-jet printing head according to claim 1, wherein: said nozzle communicating holes are formed by etching from a hole with a minute diameter.

7. An ink-jet printing head according to claim 1, wherein: said pressure generating means is constituted by a piezoelectric vibrator; said pressure generating means is extended in a direction of a row of said pressure generating chambers; and said pressure generating means is arranged on the approximately center line of said pressure generating chambers.

8. An ink-jet printing head according to claim 1, wherein: the width of adjacent pressure generating chambers is different.

9. An ink-jet printing head according to claim 1, wherein: a second ink supply port is also provided on the side of said nozzle plate; and a passage from said second ink supply port to said nozzle communicating hole is provided.

10. An ink-jet printing head according to claim 9, wherein: said nozzle aperture is formed in a position opposite to said passage.

11. An ink-jet printing head according to claim 9, wherein: said nozzle apertures are arranged in an approximately straight line.

12. An ink-jet printing head according to claim 1, wherein: said flow passage forming substrate is constituted by an anisotropically etched a monocrystalline silicon substrate.

13. An ink-jet printing head according to claim 1, further including partitions which partition adjacent pressure generating chambers, wherein a height of said partitions in areas opposite to said nozzle communicating holes is equal to a depth of said pressure generating chambers.

14. An ink-jet printing head according to claim 1, further including second pressure generating chambers and second ink supply ports formed adjacent to said nozzle plate.

15. An ink-jet printing head according to claim 14, wherein nozzle apertures are arranged along a line.

16. An ink-jet printing head according to claim 1, further including second ink supply ports formed on a side of said pressure generating chambers opposite to said ink supply ports.

17. An ink-jet printing head according to claim 1, wherein said pressure generating chamber have different widths to accommodate different types of ink.

18. An ink-jet printing head comprising:

a flow passage forming substrate made of a plate in which pressure generating chambers, at least one reservoir, ink supply ports and nozzle communicating holes are formed such that each of the pressure generating chambers communicates with the reservoir via the ink supply ports;

a nozzle plate provided with nozzles communicating with the pressure generating chambers via the nozzle communicating holes;

a pressure generator for pressurizing the pressure generating chambers;

partitions for partitioning adjacent pressure generating chambers and adjacent nozzle communicating holes;

an arbitrary pair of adjacent nozzle communicating holes;

a partition between said arbitrary pair of adjacent nozzle communicating holes; and a portion which provides a part of the partition between said arbitrary pair of adjacent nozzle communicating holes, wherein said portion has a height which is at least equal to a depth of the pressure generating chamber defined by the partitions.

* * * * *